US005467819A

United States Patent [19]

Braddick

[11] Patent Number: 5,467,819

[45] Date of Patent: Nov. 21, 1995

[54] ORIENTABLE RETRIEVABLE WHIPSTOCK AND METHOD OF USE

[75] Inventor: Britt O. Braddick, Houston, Tex.

[73] Assignee: TIW Corporation, Houston, Tex.

[21] Appl. No.: 996,958

[22] Filed: Dec. 23, 1992

[51] Int. Cl.[6] ..... E21B 7/08

[52] U.S. Cl. ..... 166/117.6; 166/206

[58] Field of Search ..... 166/117, 117.5, 166/117.6, 117.7, 206, 208, 216, 217

[56] References Cited

U.S. PATENT DOCUMENTS

| | | | |
|---|---|---|---|
| 1,367,042 | 2/1921 | Granville . | |
| 2,258,001 | 10/1941 | Chamberlain . | |
| 2,669,429 | 2/1954 | Zublin | 255/1.6 |
| 2,797,893 | 7/1957 | McCune et al. . | |
| 3,011,568 | 12/1961 | Grimm | 175/74 |
| 3,115,935 | 12/1963 | Hooton | 166/117.6 |
| 3,330,349 | 7/1967 | Owsley et al. | 166/21 |
| 3,398,804 | 8/1968 | Holbert | 175/61 |
| 3,994,340 | 11/1976 | Anderson et al. | 166/272 |
| 4,020,901 | 5/1977 | Pisio et al. | 166/50 |
| 4,307,780 | 12/1981 | Carington | 166/117.6 X |
| 4,484,627 | 11/1984 | Perkins | 166/248 |
| 4,497,381 | 2/1985 | Dickinson, III et al. | 175/61 |
| 4,519,455 | 5/1985 | Holtmyer et al. | 166/305 |
| 4,527,639 | 7/1985 | Dickinson, III et al. | 175/61 |
| 4,688,642 | 8/1987 | Baker | 166/382 |
| 4,693,327 | 9/1987 | Dickinson et al. | 175/61 |
| 4,763,734 | 8/1988 | Dickinson et al. | 175/61 |
| 4,886,126 | 12/1989 | Yates, Jr. | 175/4.54 |
| 4,953,636 | 9/1990 | Mohn | 166/65.1 |
| 4,974,672 | 12/1990 | Dickinson et al. | 166/55.1 |
| 5,035,285 | 7/1991 | Dickinson et al. | 166/65.1 |
| 5,154,231 | 10/1992 | Bailey et al. | 166/117.6 X |
| 5,193,620 | 3/1993 | Braddick | 166/117.6 X |
| 5,335,737 | 8/1994 | Baugh | 175/61 |

OTHER PUBLICATIONS

Deep Earth Sampling Systems William C. Maurer, William C. Herben Jun., 1990.

TIWSS–W5 Whipstock Packer with Anchor, 1986–1987.

Weatherford Brochure, Nov. 1993.

World Oil, Jun. 1993 pp. 41, 42, 44 & 48.

The Ultrashort–Radius, Radial System by W. Dickinson, R. R. Anderson & R. W. Dickinson Public Presentation date Feb. 10, 1986, 8 pages.

Baker Permanent Patent Systems 1984–1985.

*Primary Examiner*—Terry Lee Melius

*Attorney, Agent, or Firm*—Browning, Bushman, Anderson & Brookhart

[57] ABSTRACT

An anchor (A) is secured in a cased well bore by a setting tool (T) having latch (10) that releasably secures with the anchor (A). A whipstock (27) has surfaces (33) which are engaged with shaft surfaces (32) at the earth's surface to orient the whipstock to face in a desired direction. The whipstock (27) is then lowered into a cased well bore and releasably latched to the anchor (A) by retrievable latch (35) engaged in recess (3) of the anchor and secured against rotation by surface 31*d* engaged in whipstock latching surface 8 on the anchor (A). A lateral well bore (47) can then be drilled from the cased well bore in the desired direction and at the desired elevation. The whipstock (27) may be connected with a drill string (DS) for lowering into an anchor (A) in the well bore. If desired, an ordinary well string 53 with latch arrangement (77) cooperates with latch arrangement (78) in the whipstock (27) to retrieve the whipstock from the anchor (A), or to position the whipstock in the anchor (A).

62 Claims, 7 Drawing Sheets

ORIENTABLE RETRIEVABLE WHIPSTOCK AND METHOD OF USE

STATEMENT OF THE PRIOR ART

It is well known to use whipstocks in drilling to direct or deviate a drill bit or cutter at an angle from a cased well bore. It is generally customary in most instances to initially set a cement plug, a packer and a whipstock at the desired elevation in a well tubular member such as a casing.

The orienting of the whipstock is then accomplished in a well known manner and generally requires a multiple trip operation into and out of the cased well bore.

It can be appreciated that problems may arise if undesired rotation of the whipstock occurs after orientation and before setting the packer. Presently,the whipstock and packer are left in the casing in the well bore which blocks access to the cased well bore therebeneath.

In some instances, it is desirable to leave the cased well bore open from which the lateral well bore is drilled, but this cannot be done with present whipstock structures and setting methods.

SUMMARY OF THE INVENTION

A retrievable whipstock arrangement includes a whipstock with a tapered face thereon, which whipstock can be releasably and non rotatably positioned in an anchor secured with a cased well bore to position the whipstock face in the cased well bore in a desired direction. A latch mandrel forming part of a shaft depending from the whipstock supports a latch that is releasably engagable with the anchor secured in the cased well bore, whereby the whipstock may be retrieved from the cased well bore.

Cooperating surfaces on the orientation sleeve portion of the shaft and on the whipstock enable the whipstock to be rotated and locked in a desired rotated position on the shaft at the earth's surface which positions and maintains the whipstock face in a desired direction when surfaces on the orientation sleeve and the anchor secured in the cased well bore are engaged.

The anchor includes means to secure it with the casing and maintain it secured with the casing.

Where the whipstock is not lowered on a drill string into the cased well bore, it may be lowered on a well string and releasably, but non rotatably, latched to the anchor. The well string and whipstock are provided with cooperating latch arrangements to enable the whipstock to be lowered and engaged with the anchor by the well string and the well string then released from the whipstock without changing the direction in which the whipstock faces in the cased well bore.

The well string may be reingaged with the whipstock for retrieving it from the cased well bore which leaves the cased well bore open for access.

An object of the present invention is to provide a method and apparatus for releasably and non rotatably latch a whipstock to an anchor secured in a cased well bore.

Another object is to provide a method and apparatus to latch a whipstock with a well string to lower and releasably position the whipstock in an anchor secured in a cased well bore to face in a desired direction in the cased well bore, which well string may be then disengaged from the whipstock after the whipstock is releasably positioned in the anchor while maintaining the whipstock releasably, and non rotatably positioned in the anchor to face in the desired direction.

One object of the present invention is to provide an arrangement and method for lowering a retrievable whipstock into an anchor secured in a well bore casing for drilling a lateral well bore and thereafter retrieving the whipstock. This leaves the cased well bore from which the lateral well bore is drilled accessible for whatever purpose may be desired or necessary such as, by way of example only, for receiving a flow conduit below the anchor to conduct fluids from such cased well bore.

Another object of the present invention is to provide an arrangement and method for lowering a retrievable whipstock into an anchor in a cased well bore casing for drilling a lateral well bore, retrieving the drill string and then retrieving the whipstock.

Still a further object of the present invention is to provide a method and apparatus for drilling a desired number of lateral well bores from the same cased well bore.

Another object is to provide an arrangement and method for lowering a retrievable whipstock into an anchor in a cased well bore for stepwise drilling a plurality of lateral well bores in any desired direction and elevation from the cased well bore and leaving the cased well bore open from which the lateral well bores are drilled.

Another object is to provide a method and apparatus for releasably securing a whipstock with an anchor in a cased well bore and for retrieving the whipstock from the anchor.

Yet a further object is to provide a method and apparatus for securing a retrievable whipstock face in any desired rotated relationship relative to an anchor secured in a cased well bore.

Still a further object is to provide a method and apparatus for lowering a whipstock into a cased well bore on a well string to secure the whipstock with an anchor and the well string then released and retrieved from the cased well bore in a manner to inhibit unthreading the joints forming the well string.

Still a further object is to provide a method and apparatus for lowering a whipstock into a cased well bore on a well string to secure the whipstock with an anchor and the well string then released and retrieved from the cased well bore, and thereafter reengaging the well string with the whipstock to retrieve it.

A further object of the invention is to secure an anchor in a cased well bore that is configured for receiving a whipstock that supports a latch for releasably securing the whipstock in the anchor in a desired direction for drilling a lateral well bore from the cased well bore.

A further object of the invention is to provide a whipstock that supports a latch for releasably securing the whipstock in an anchor for drilling lateral well bores from a cased well bore. The whipstock includes a surface for maintaining the latch engaged with the anchor. Cooperating surfaces on the anchor and and whipstock face the whipstock in a desired direction while the whipstock is in use to drill the lateral well bore.

Still another object of the invention is to enhance production of oil and gas from a cased well bore by drilling lateral well bores from the cased well bore.

A further object of the invention is to provide an arrangement to enable a whipstock face to be positioned in any desired direction at the earth's surface and then lowered into a cased well bore for drilling lateral well bores in desired directions from the cased well bore and the whipstock then retrieved.

Other objects and advantages of the present invention will become more readily apparent from a consideration of the following drawings and description.

DESCRIPTION OF THE PREFERRED EMBODIMENT

Figure 1:
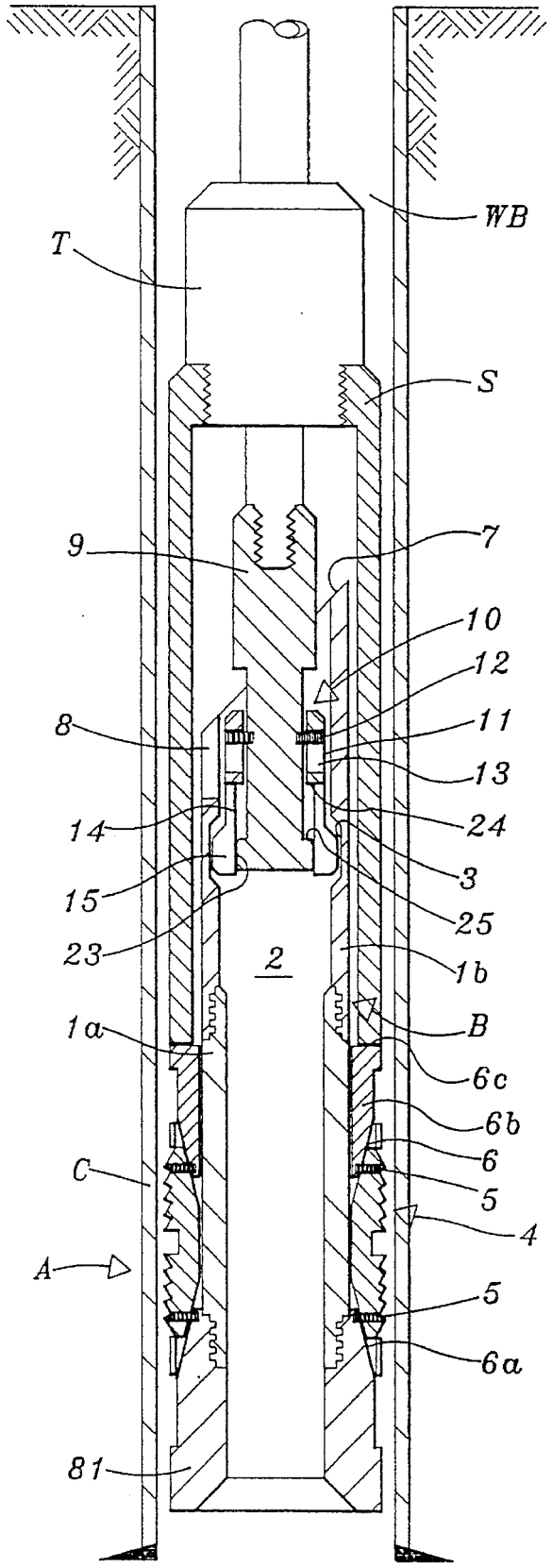
FIG. 1 is a sectional schematic view showing one form of an anchor, with one form of latch supported on a setting tool for releasably connecting the setting tool and anchor.
Figure 2:
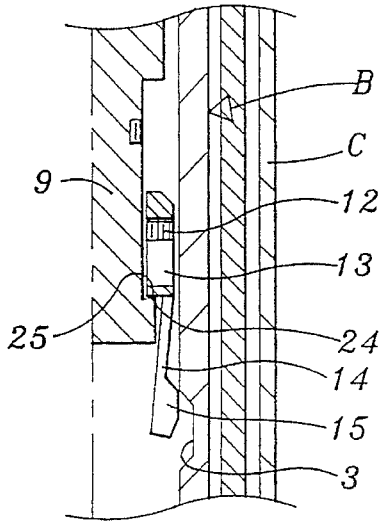
FIG. 2 is an enlarged partial sectional view of FIG. 1 showing the anchor form of FIG. 1 releasing the setting tool from the anchor form of FIG. 1 after the anchor has been secured in the a well bore tubular member.
Figure 3:
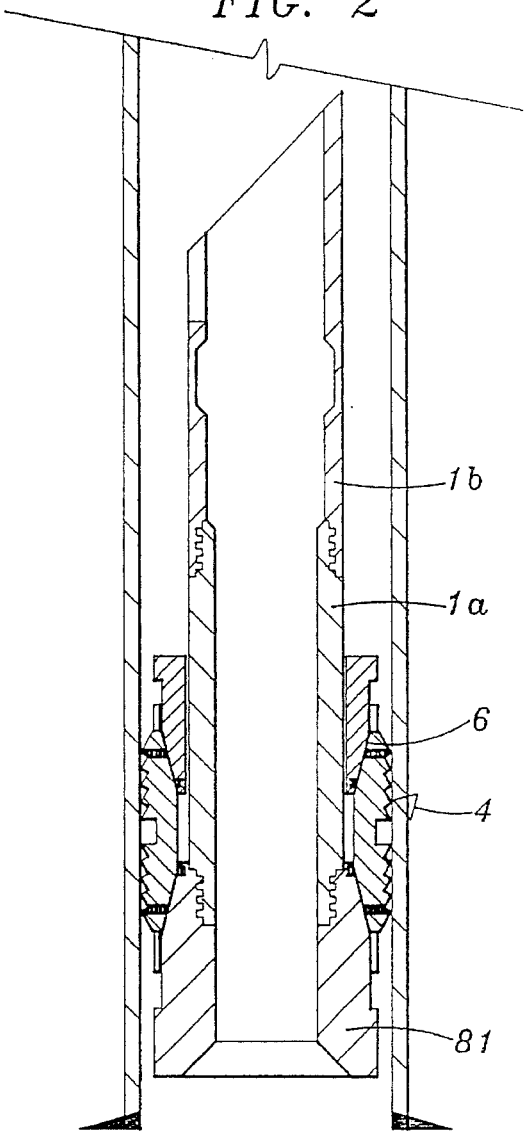
FIG. 3 is a sectional view showing the anchor form of FIG. 1 secured in the well bore tubular member.

Attention is first directed to FIGS. 1–3 of the drawings wherein an arrangement is shown for securing an anchor, represented generally at A, in a well bore tubular member, such as a casing C in cased well bore WB. The anchor A includes a body B of any suitable configuration.

In the embodiment shown, the body B is illustrated as being tubular and is formed of lower tubular element 1*a* and an upper tubular element 1*b* threadedly connected with tubular element 1*a* which is connected with lower cone 81. The body B is preferably tubular and includes a longitudinal bore 2 therethrough.

Figure 5:
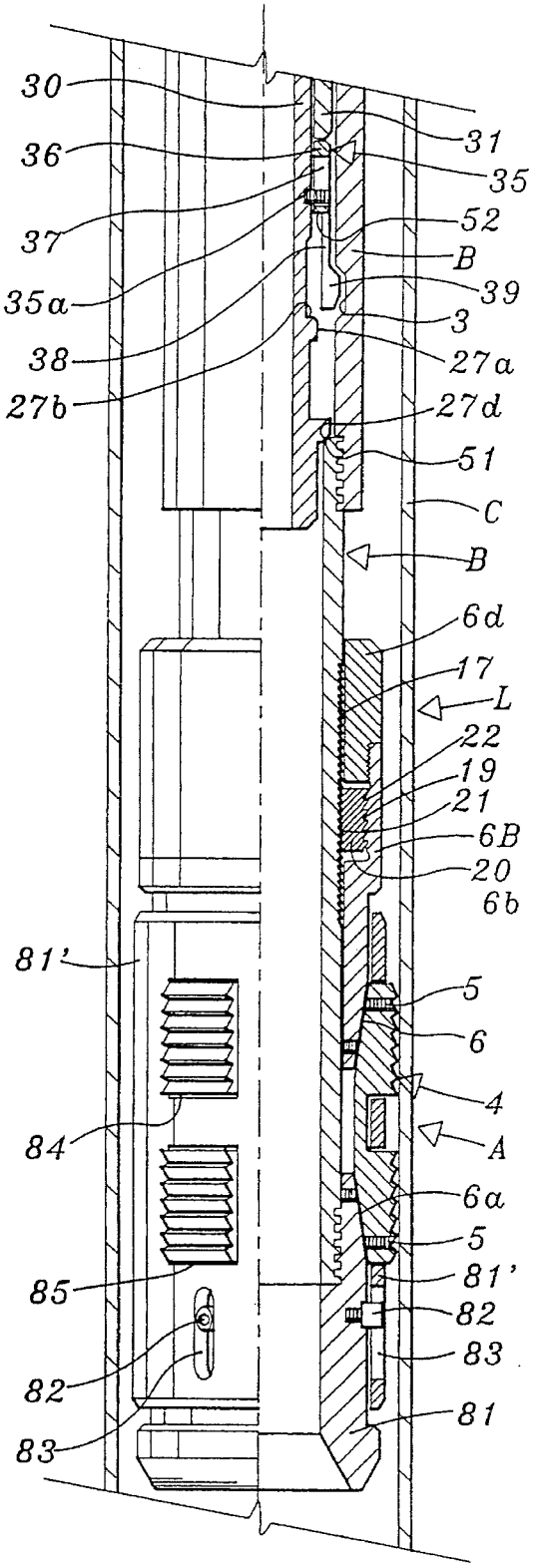

An anchor surface on the anchor is provided and may be of any suitable configuration and is shown as being in the form of an internal groove or annular recess 3 in the bore 2 of the body. Slip means 4 are supported on the anchor in any suitable manner and are shown in FIGS. 1, 3 and 5 as secured by frangible means, such as shear pins 5 adjacent, or on tapered surfaces 6 and 6*a*, respectively, on upper and lower spaced tubular portions 6*b* and cage 81 on the tubular body of the anchor. The shear pins 5 extend through the tapered surfaces 6 and 6*a* and into the slip means 4 of the anchor to maintain the tapered surfaces in spaced relation as the tool is lowered into the well bore and until the setting tool, represented generally by T, is actuated to effect relative movement between the tapered surfaces and the slip means to shear pins 5 for moving the slip means to engage the tubular member and secure the anchor with the tubular member.

The upper end of body B in the embodiment shown terminates in an inclined surface 7, and where the body B is tubular with a bore 2, which is the preferred embodiment, the surface 7 is an annular edge surface. A whipstock latch surface extends in the tubular body B from the edge 7. In the form shown, the whipstock latch surface is a slot as shown at 8 that extends from the lowermost portion of the tapered surface as shown in the drawings, but it may assume other configurations, such as, by way of example only, a longitudinal recess on the internal wall of the body or other form as desired.

A setting arrangement or setting tool T of any suitable type may be employed to lower and secure the anchor in a tubular member such as cased well bore or the like. For example only, a wireline setting tool or hydraulically actuated setting tool may be employed.

The setting tool includes a shaft, rod, or adapter 9 on which releasable means such as a latch referred to generally at 10 of any suitable form may be supported. In the form shown, the latch 10 includes an annular body 11 with frangible means such as shear pins 12 adjacent the upper end thereof for releasably securing the latch 10 on the shaft 9 as shown in FIG. 1. The shear pins 12 extend through the circumferentially spaced, longitudinally extending slots 13 of body 11 and into shaft 9 as shown in FIGS. 1 and 2. The slots terminate adjacent, but spaced from the upper end and bottom end of body 11 as shown. Extending from the bottom end of latch body 11 are circumferentially spaced, longitudinally extending members 14 which have external enlargements, or latch surfaces thereon represented at 15 for positioning within the recess, or anchor surface 3.

The arrangement including the setting tool, latch 10 and anchor A are assembled at the earth's surface in a manner well known in the art to connect them together for lowering into the cased well bore as shown in FIG. 1 with the shear pins 12 adjacent the upper end of slots 13 and latch surfaces 15 in the anchor surface 3.

A wireline or well string, depending upon the setting arrangement employed, is used to lower the arrangement into the cased well bore. The setting tool includes a first surface 23 on shaft or adapter 9, shown in the form of a radially extending portion on shaft 9, which is positioned adjacent the enlargements 15 when they are positioned in the recess 3. This prevents the latch 10 from prematurely releasing from the tubular Body B until the setting tool is actuated.

Actuation of the setting tool and setting the slips moves shaft or adapter 9 up. Increased force applied to adapter 9 through actuation of the setting tool T after setting of the anchor A in the casing C of the well bore breaks shear pin 12 as the adapter moves upward relative to latch 10. Continued upward movement of the adapter 9 relative to latch 10 causes the bottom surface 24 of the latch 10 to engage with the ledge 25 on the shaft or adapter 9 to remove the latch 10 from the secured anchor A and retrieve the latch 10 with the setting tool to the earth's surface.

The lower portion of FIG. 5 illustrates further details of the anchor A not seen in FIG. 1. A lock means, referred to generally at L is provided to maintain the anchor secured with the tubular with the tubular member C.

The lock L may assume any desired form and in the form shown includes a ratchet surface 17 extending longitudinally on the outer surface of tubular body B of the anchor. The tubular portion **6*b* has an internal tapered thread 19 in annular spaced relation to the ratchet thread 17 on tubular body B. A split ratchet ring 20 is between tubular portion 6*b* and the tubular body B. The split or segmented ratchet ring 20 has a ratchet thread 21 on its inner surface and a tapered thread 22 on its outer surface. These surfaces cooperate to accommodate relative movement between the tubular portion 6*b* and the tubular body B when the setting tool is actuated so that the tapered surfaces 6 and 6*a* move the slips into securing relation with the tubular member C. The ratchet surfaces lock the tubular portion 6*b* and cage 81 with tubular body B so the slip means 4** is locked in engagement with the tubular member C in the well bore when the setting tool is actuated in a manner well known in the art.

The setting arrangement including the setting tool T with sleeve S thereon and anchor A are assembled as shown in FIG. 1 at the earth's surface. Sleeve S, as shown in FIG. 1 abuts the upper end **6*c* of the tubular portion 6*b* on which tapered surface 6 is formed. When the setting tool is actuated, relative movement is effected between setting sleeve S and tubular body B in a manner well known in the art to set the slip means 4 and to cause the surfaces of the lock L to cooperate to accommodate relative movement and then lock the tubular portion 6*b*, split ring 20** and the body B in engaged relation to maintain the slips engaged with the tubular member C in the well bore.

An application of force causes setting of the slips 4 in a manner well known in the art, after which the pins 12 are sheared upon upward movement of the setting tool. The setting tool is then removed from the anchor A and ledge, or second surface, 25 on the setting string or tool, engages with the bottom 24 of the latch to retrieve it from the anchor and well bore along with the setting tool as illustrated in FIG. 2 of the drawing.

Figure 13:
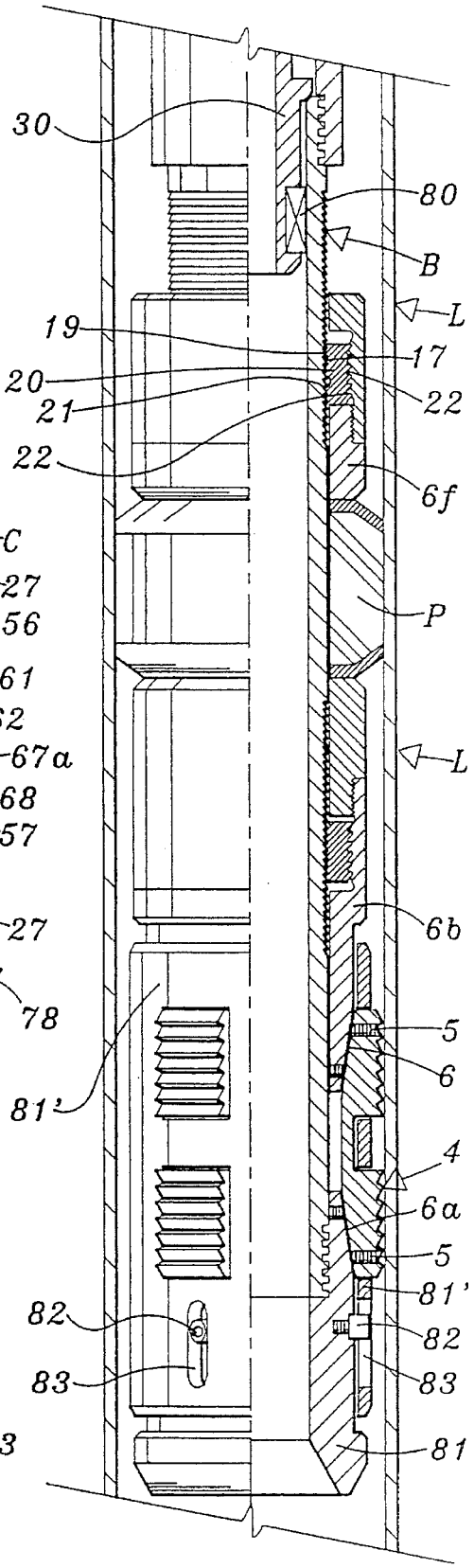
FIG. 13 is a sectional view of a packer anchor and with a seal between the anchor and whipstock.

FIG. 13 illustrates another form of the anchor A which includes the packer P on the tubular body above the slip means. In this instance it may be desirable to provide a lock L above and below the packer to maintain the slips secured with the tubular member should the packer deteriorate or disintegrate.

The lock L above the packer P is shown as being the same as that in the FIG. 5 form of the anchor, with like numerals representing like parts.

The lock L above the packer P is similar to that shown below the packer in FIG. 5 in that it employs a tubular portion **6*f* above the packer, but it has no tapered surface. Other parts are similar with like numerals representing like parts of the lock L below the packer. A seal 80 is provided on the latch mandrel 30 between the latch mandrel 30 and the body B. The member 6*d* closes off the upper end of tubular portion 6*b***.

Figure 4:
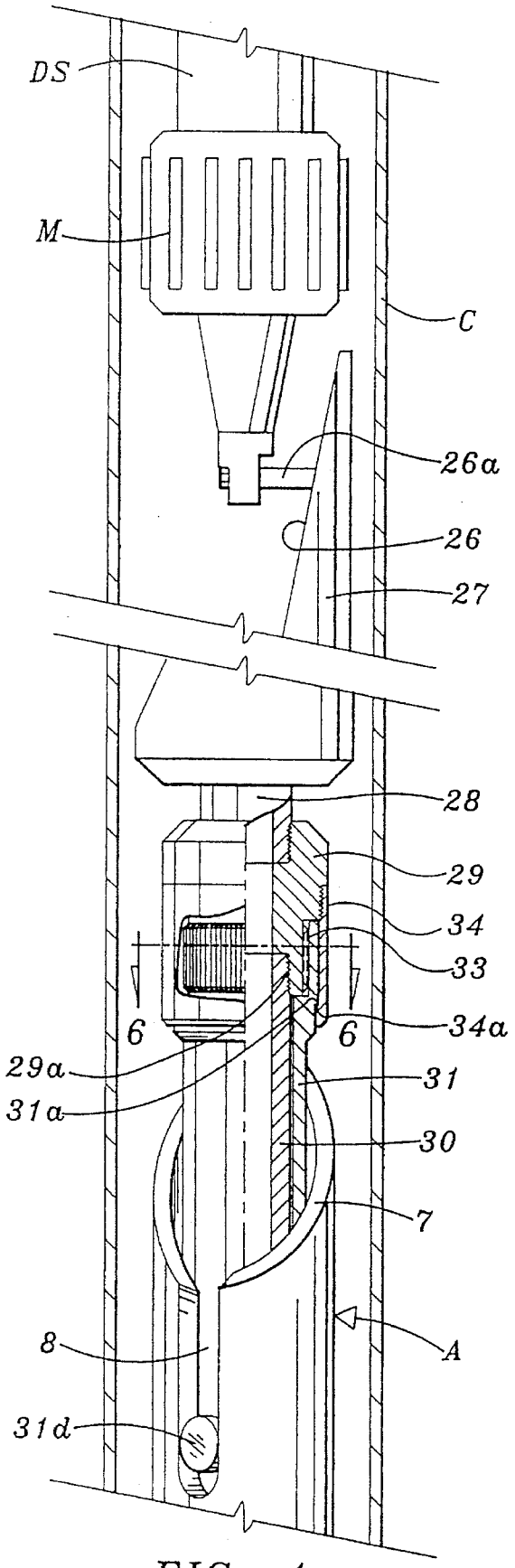
FIGS. 4 and 5 are sectional views, partly in elevation illustrating a whipstock secured on a drill string and being lowered into the anchor form of FIG. 1 and releasably secured therewith by latch means on a shaft connected to the whipstock and depending therefrom. One form of cooperating surfaces on the whipstock and shaft to enable the whipstock to be positioned at the earth's surface to face in a locked, rotated position, if necessary, relative to the whipstock latch surface, such as a slot in the anchor, is also shown.

FIGS. 4 and 5 show one form of the arrangement of the present invention wherein a mill M is releasably connected adjacent the lower end of a drill string DS. A whipstock 27 is connected with the drill string beneath the mill by frangible means such as shear pin **26*a* which connects the drill string with the whipstock at face 26. An extension 28 depends from the lower end of the whipstock 27 and includes coupling 29** connected therewith by any suitable means such as threads as shown.

A shaft is connected to the whipstock 27. The shaft in the embodiment illustrated in the drawings is formed by the orientation sleeve 31 which receives therein and partially surrounds latch mandrel 30 as shown in the drawings. The latch mandrel 30 and orientation sleeve 31 are shown as each being connected to the extension 28 by coupling 29 of the whipstock and may be considered as part of the whipstock.

The extension 28 of the whipstock is threaded and shouldered with coupling 29 which limits the make—up of the threaded connection between extension 28 and coupling 29. The orientation sleeve 31 of the shaft and the whipstock are provided with cooperating surfaces for locking and maintaining the whipstock face in any desired rotated position on the shaft to enable a lateral well bore to be drilled in a desired direction from the cased well bore. This relationship is maintained when the whipstock is non rotatably positioned in the anchor A in the cased well bore.

Figure 6:
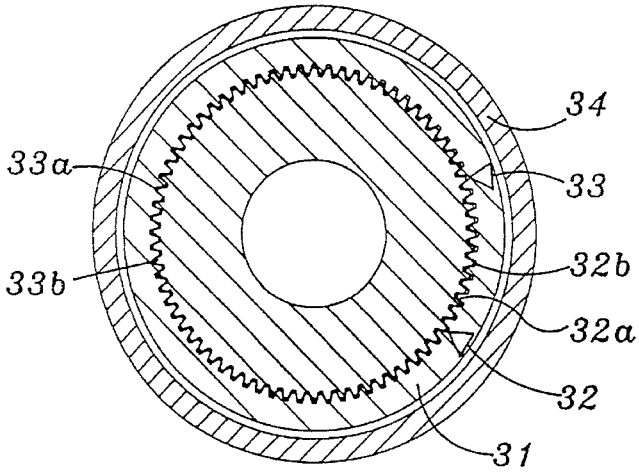
FIG. 6 is an enlarged sectional view on the line 6—6 of FIG. 4 which shows in greater detail one form of the cooperating surfaces on the whipstock and shaft to secure the whipstock in a desired rotated position on a shaft to position the face of the whipstock in a desired direction when the whipstock is secured with the anchor.

The cooperating surfaces on the whipstock and the shaft which initially determine and maintain this relationship may assume any desired configuration, and one form is illustrated in FIG. 6 of the drawings. The cooperating surfaces comprise internal splines, referred to generally at 32, or internal keys **32*a* and keyways 32*b* on the orientation sleeve 31 of the shaft adjacent its upper end, which engage with external splines, referred to generally at 33, or external keyways 33*a* and keys 33*b*, formed on the coupling 29 of the whipstock. The keys 32*a* engage in keyways 33*a* and the keyways 32*b* receive keys 33*b***.

Any suitable number of splines or keys and keyways may be provided on the whipstock and the orientation sleeve of the shaft, as desired. The greater the number of splines, the smaller the angle therebetween to more finitely adjust the face of the whipstock. The splines are represented as immediately adjacent in FIG. 6, but they may be circumferentially spaced if desired.

A lock sleeve 34, as shown in FIG. 4 is provided with threads to engage with the coupling 29 as shown and an annular shoulder **34*a* on lock sleeve 34 abuts an annular shoulder 31***a* on the orientation sleeve 31 of the shaft as shown to lock the whipstock face 26 in any desired rotated position on the orientation sleeve 31 of the shaft as shown. The cooperating surfaces on the whipstock illustrated as the lug 31*d* and the slot 8 in the anchor prevent relative rotation between the whipstock and the anchor secured in the cased well bore. The cooperating surfaces may assume any desired configuration.

The lower end of tubular body B of the anchor A is connected to lower cone 81 by suitable means such as threads as shown in the drawings. The lower tapered or conical surface 6*a* is formed on lower cone 81 and the cage 81' includes circumferentially spaced slots 83 in which are positioned cap screws 82 that are secured on the lower cone 81. The slip means comprise upper and lower slip means 4 that are positioned on the upper and lower conical surfaces 6 and 6*a* respectively. The slips extend through circumferentially spaced windows 84 and 85 of cage 81' which engage and grip the inner surface of the casing C upon setting of the anchor A by the setting tool, by way of example only, the surface on the orientation sleeve 31 is shown as a projecting lug 31*d* on the orientation sleeve of the shaft which engages in the whipstock latch surface, shown in the form of slot 8, when the whipstock and shaft are positioned in and releasably latched with the anchor A, and when so engaged, no relative rotation between the whipstock face 26 and the casing occurs.

Thus, the whipstock arrangement of the present invention precludes relative rotation between the whipstock face and casing C when the whipstock 27 is positioned and releasably latched with the anchor A in the casing C.

A latch 35 is supported on the whipstock in any suitable manner and as shown in the form of the invention illustrated in the drawings, the latch 35 is supported on the whipstock by latch mandrel 30 of the shaft. The latch mandrel 30 is secured by threads 29*a* to the coupling 29 that is connected with the whipstock.

The latch 35 is similar to latch 10, but different reference numerals are applied to describe it and distinguish it from latch 10.

The latch referred to generally at 35 includes a body 36 releasably secured to the latch mandrel 30 by shear pins 35*a* which extend through longitudinal slots 37 therein and into the latch mandrel as shown.

The shear pins 35*a* are stronger than the shear pins 26*a* which secure the mill to the drill string and thus the mill can be released without affecting the connection of the whipstock and latch mandrel 30 of the shaft with tubular body B of the anchor A.

Circumferentially spaced members 38 depend from body 36 and the members 38 have enlargements 39 adjacent their lower ends as shown and described with respect to the latch 10 that releasably secures the whipstock and drill string with the anchor A to secure the whipstock in the desired direction to enable a lateral well bore to be drilled from the cased well bore. The latch mandrel of the shaft, as previously noted, is connected to and may be considered as part of the whipstock.

The surface 27*d* on the latch mandrel 30 seats on shoulder 51 of the body B when the lug 31*d* is seated in the slot 8 of the body B, as shown in FIGS. 4 and 5. The first, or annular surface 27*a*, on the latch mandrel 30 of the shaft is adjacent the enlargements 39 in recess 3 and since the latch mandrel 30 is seated on shoulder 51 it cannot move down. Should up movement occur, the first, or annular surface 27*a* moves to a position adjacent and internal relative to enlargements 39 to prevent inward flexing of members 38, thus preventing enlargements 39 from moving out of recess 3.

The enlargements 39 position in the recess 3 of the tubular body B of the anchor when the drill string, mill and whipstock, as shown in FIGS. 4 and 5 are lowered into the anchor A secured in the cased well bore. The whipstock latch surface, in the form of the invention illustrated, is the longitudinal slot 8 in the anchor A. Lug 31*d* on the orienting sleeve 31 of the shaft engages the inclined surface 7 of the tubular body B when the whipstock arrangement is lowered into the anchor A and the lug 31*d* on the orientation sleeve 31 of the shaft is guided into the slot 8 to position the shaft with the anchor.

After the anchor is positioned in the well bore tubular member in the manner as previously described, the orientation of the whipstock latch surface in the form of slot 8 in the anchor A is determined, in a manner well known in the art, so that the whipstock face may be rotated, or positioned, and secured on the orientation sleeve shaft 31 of the shaft at the earth's surface to face in the desired direction when engaged in the anchor A to enable a lateral well bore to be drilled from the cased well bore in which the whipstock is positioned.

Figure 3A:
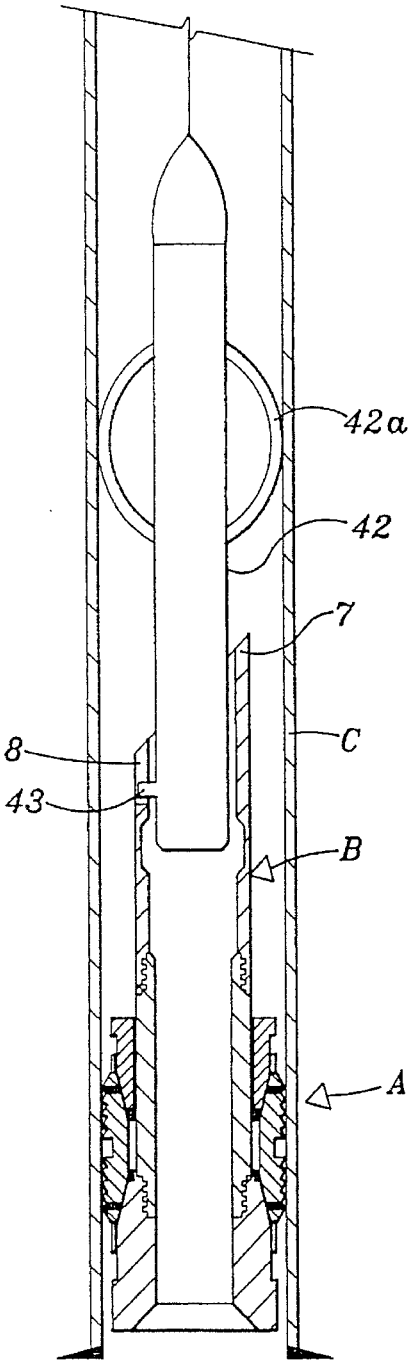
FIG. 3A is a sectional schematic view of a survey mechanism, or instrument, for determining the orientation, or direction of a whipstock latch surface in the anchor for enabling the whipstock to be rotated and locked on the shaft at the earth's surface in a predetermined position to face in a desired direction when it is positioned and secured in the anchor.

FIG. 3A schematically represents a mechanism, or instrument, well known in the art for lowering into a cased well bore on a wireline as shown to conduct and record a survey that determines the orientation, or direction, of a surface relative to a predetermined direction, such as magnetic North, in a well bore. A tool is schematically represented 42 with a centralizer represented at 42*a*. The tool 42 includes a pin or lug 43 that engages in slot 8 and enables the tool to determine the orientation of the pin 43 which is also the orientation of slot 8 of the anchor. The apparatus and method of obtaining the survey is well known to those skilled in the art, and no detailed explanation is deemed necessary.

With this information, any person skilled in the art can then disconnect orientating sleeve 31 of the shaft from the whipstock 27 and rotate it to position the face of the whipstock as desired. When the whipstock is reconnected to the orienting shaft 31 by the splines, and the whipstock lowered into the anchor so lug 31*d* is in slot 8, the whipstock face 26 will be secured in the cased well bore in the direction in which it is desired to drill the lateral well bore.

The foregoing arrangement and method enables the whipstock to be adjusted at the earth's surface to face in any desired direction in the cased well bore to enable a lateral well bore to be drilled in a well known manner.

After the anchor A has been set in the well bore, the above survey run, and the whipstock connected with orienting sleeve 31 in light of the information obtained from the survey, the arrangement of FIGS. 4 and 5, is run into the well bore on a drill string. Lug 31*d* is engaged with the whipstock latch surface 8 in the anchor, and latch 35 releasably secures the drill string and whipstock with the anchor A to secure whipstock face 26 in the direction in which it is desired to drill from the cased well bore in which the whipstock is set.

Figure 14:
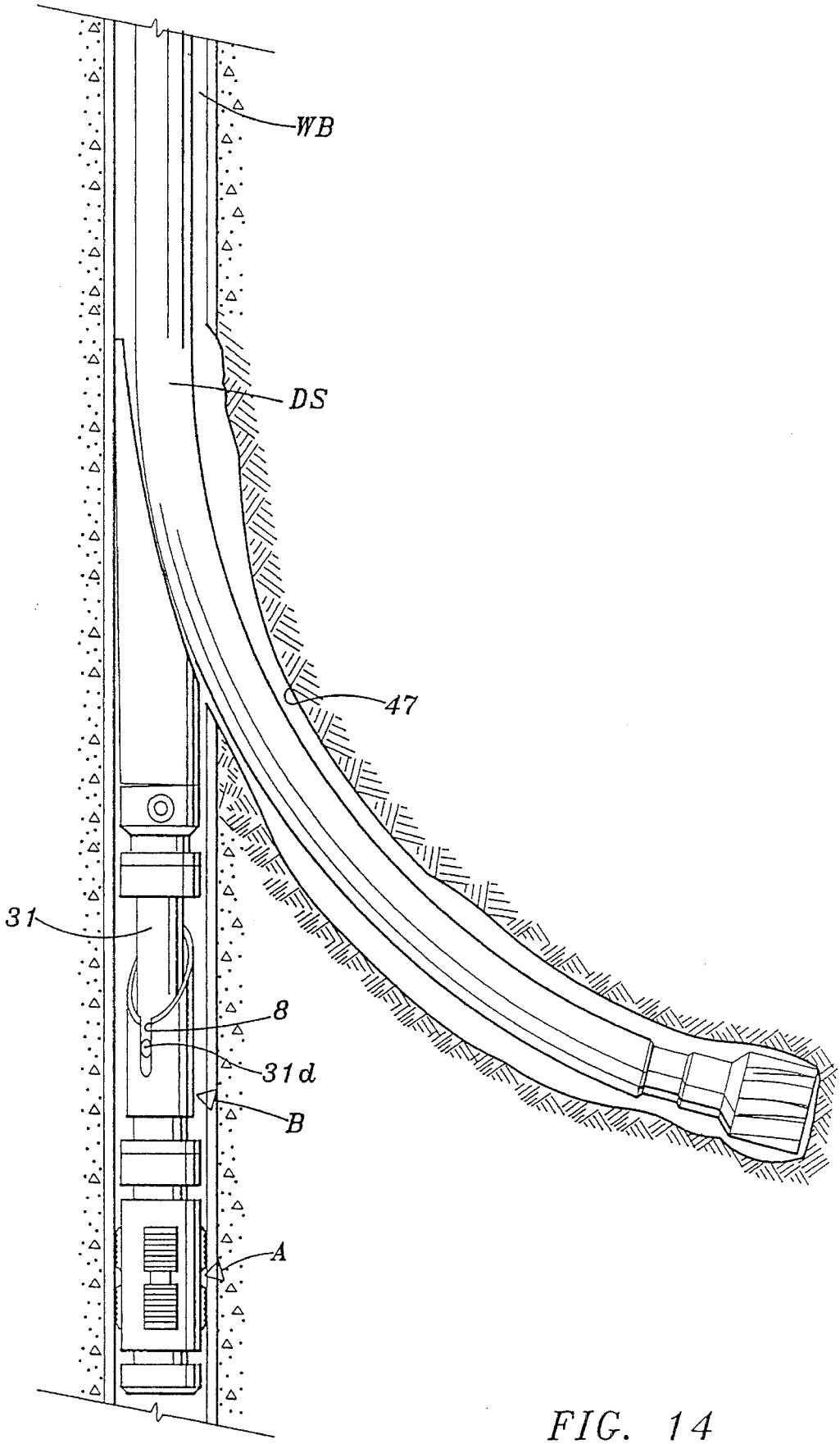
FIG. 14 is a sectional view, partly in elevation, of a cased well bore illustrating an anchor with the whipstock secured therewith to position the whipstock face in a desired manner for receiving a drill string to drill the lateral well bore shown.

The mill is released from the whipstock by manipulating the whipstock either up or down to shear pin 26*a*. The first surface 27*a* prevents the enlargements from withdrawing out of surface in the tubular body B of the anchor. The drill string is then manipulated to move the drill string and mill down to cut a window in the casing C and to perform the desired drilling operations to drill a lateral well bore, such as illustrated at 47 from the cased well bore WB as shown in FIG. 14. The drill string is then retrieved from the cased and lateral well bores to the earth's surface.

Figure 16:
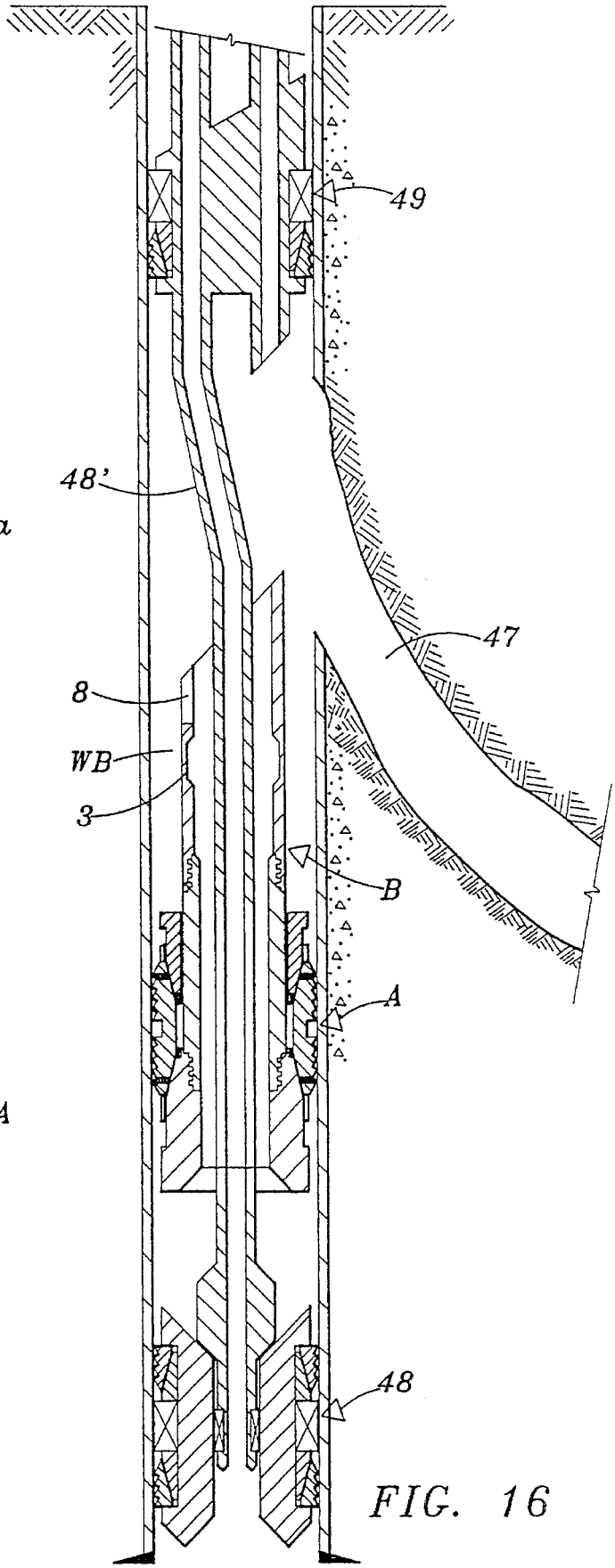
FIG. 16 is a sectional view illustrating one possible arrangement of production equipment positioned in a cased well bore for communicating separately with the cased well bore and the lateral well bore after the whipstock has been retrieved from the cased well bore.

The drill string may incorporate suitable drilling tools to drill the lateral well bore 47 and in some instances the drill string and mill are retrieved from the cased well bore after the mill has cut the window in the casing C and drill tools added as desired to drill the lateral well bore and the drill string lowered back into the cased well bore to drill the lateral well bore. The whipstock may then be retrieved to the earth's surface, as will be described. Removal of the whipstock leaves the cased well bore open and unrestricted for access to position suitable production equipment in the cased well bore, as may be desired.

Where it is desired to maintain the fluids produced from the lateral well bore separate from the fluids produced from the cased well bore from which the lateral well bore was drilled, suitable production equipment is initially installed in the cased well bore before the anchor A is set therein. FIG. 16 illustrates one suitable arrangement showing a seal bore packer 48.

After drilling the lateral well bore from cased well bore WB, a suitable multi-string packer 49 may be set in a well known manner above the anchor A as shown in FIG. 16. Production tubing 48' may then be connected there through and through the anchor A to engage in seal bore packer 48 to conduct flow from cased well bore WB to the earth's surface separately from lateral bore 47. As shown, a separate packer conduit conducts flow from the lateral well bore. In the absence of a multi-string packer 49, production from the lateral well bore 47 may be brought to the earth's surface via the annular space between the production tubing and the casing C of the cased well bore.

Another alternative is to omit the multi-string packer 49 and employ the packer anchor form of FIG. 13. It then provides a seal bore packer and the production tubing 48' may be sealably engaged within the bore of the tubular body B of the anchor. The seal 80 and the packer P seal off the well bore below the packer anchor for flow through the production string to the earth's surface.

Where there is no need to maintain the flow from the cased well bore separate from the flow from a lateral well bore, they remain in communication for flow to the earth's surface.

In some instances it may be desirable to drill a plurality of lateral well bores from the same well cased bore WB, and in selected varying directions or elevations. In such situations, the whipstock is retrieved after the drill string is removed from drilling a lateral well bore, and the whipstock and orientation sleeve of the shaft disengaged to enable the cooperating surfaces on the whipstock and orientation sleeve of the shaft to be released from each other.

To accomplish this, the lock sleeve 34 is removed. The orientation sleeve of the shaft and whipstock can then be manipulated to disengage their respective cooperating surfaces, which in the embodiment shown are keys and keyways.

The orientation of the surface, or slot 8 in the anchor A is known from previous drilling, or the survey may be reconducted. With the information from the previous survey or a new survey, relative rotation between the whipstock and the orientation sleeve 31 of the shaft is effected and then the keys and keyways on the whipstock and orientation sleeve reconnected so that the whipstock will face in the desired direction when secured in the anchor to enable the lateral well bore to be drilled in such desired direction.

The whipstock is then relowered into the well bore and reingaged in the anchor for drilling the next lateral well bore. This procedure may be repeated to drill whatever number of lateral well bores as desired and in whatever selected directions.

Figure 15:
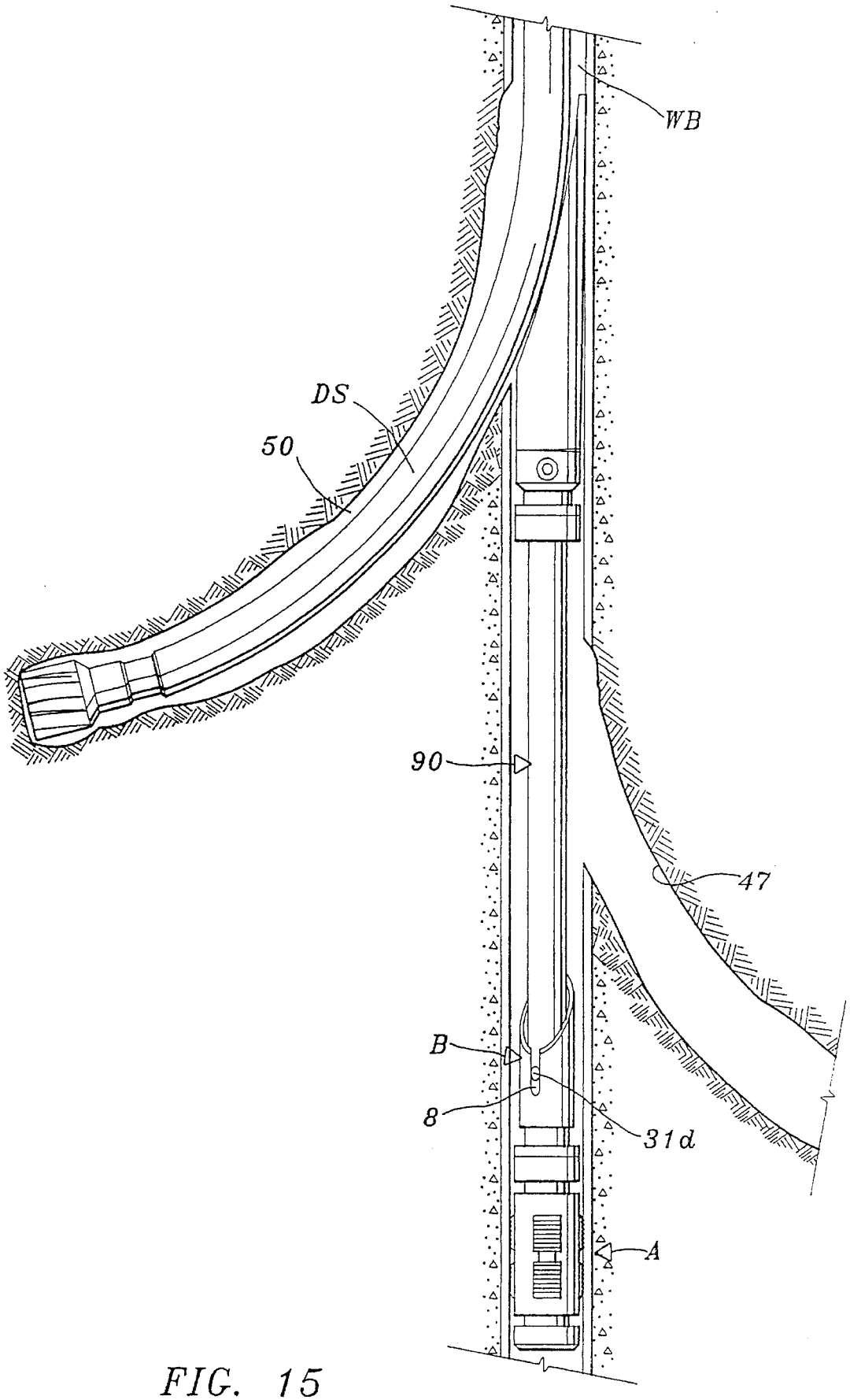
FIG. 15 is a view similar to FIG. 14 and showing a plurality of lateral well bores drilled from the cased well bore in desired directions and at selected elevations from the cased well bore.

If the elevation of the additional lateral well bores drilled from the cased well bore is to vary, then the length of the extension 28 on the whipstock may be varied accordingly to space the whipstock longitudinally from the anchor A and any other laterals as desired such as lateral 47 as shown in FIG. 15 to drill the additional laterals.

FIG. 15 illustrates two lateral well bores drilled from the cased well bore WB. Like numerals are applied to corresponding components as previously described.

Figure 7:
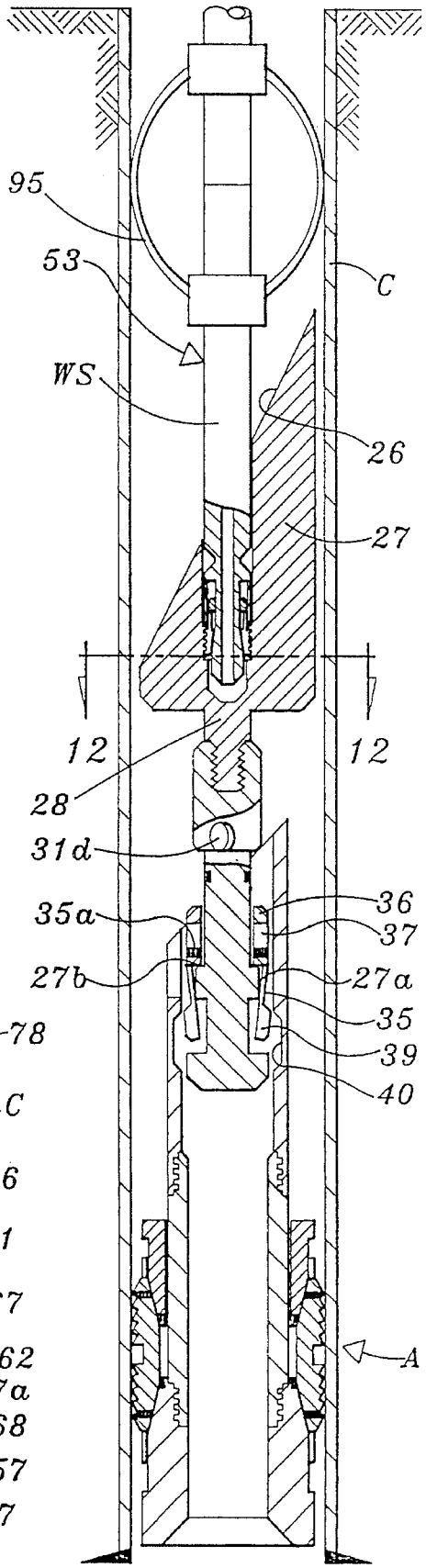
FIG. 7 schematically illustrates an arrangement for releasing a whipstock from an anchor and also an arrangement for latching with a whipstock to position it in or retrieve it from a cased well bore.

In FIG. 7 the shaft formed by the latch mandrel 30 and orienting sleeve 31 is schematically illustrated as secured with and depending from the whipstock 27 and a well string 53 is latched with the whipstock. The well string 53 may be employed to retrieve the whipstock and in some instances it may be desirable to lower the whipstock on a well string 53 to secure the whipstock in the anchor, release the well string from the whipstock, retrieve the well string then lower a drill string into the cased well bore to drill the lateral well bore, retrieve the drill string and then retrieve the whipstock.

Cooperating latch arrangements , one form of which is shown in FIGS. 8–11 inclusive, is referred to generally at 77 on the well string 53, and referred to generally at 78 on the whipstock 27 . The cooperating latch arrangements 77 and 78 enable the whipstock and a well string to be releasably engaged for lowering the whipstock into the anchor by a well string, to enable the well string to be manipulated to be released therefrom after the whipstock is latched in the anchor and retrieved and to enable the well string to be lowered and reingaged with the whipstock to retrieve it.

The cooperating latch arrangements on the well string and the whipstock also enables the whipstock to be engaged and latched with the well string by longitudinal movement. It also enables the well string to be disengaged from the whipstock by right hand rotation of the well string which avoids left hand rotation and the attendant possibility of unthreading the well string in the well bore.

The cooperating latch arrangement on the whipstock comprises an opening 56 in the whipstock which extends down from the face 26 of the whipstock with threads 57 formed thereon as shown in FIGS. 8, 9, 10, and 11.

The cooperating latch arrangement on the well string 53 includes an annular counter bore 58 extending from the upper end 59 of a circumferential slot 60. The counter bore 58 forms or provides an outer annular circular portion 61 with a lower end 62 that terminates in spaced relation to the lower end, shown in dotted line at 63, of the circumferential slot on the well string 53.

A latch represented at 65 has an annular body 66 that slidably fits within the counter bore 58. Circumferentially spaced members 67 extend from the body toward the lower end 63 of slot 60. The members 67 have an enlargement **67*a* adjacent their lower ends with threads 68 on the enlargements, which threads are configured to engage with threads 57** on the whipstock as will be described.

Figure 12:
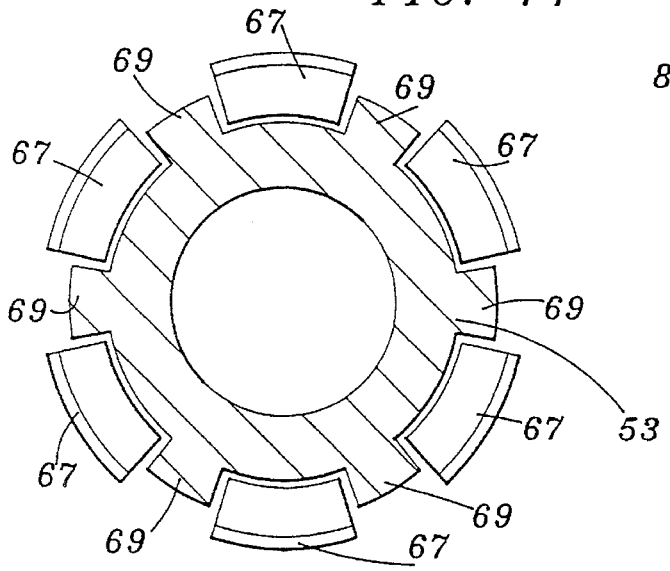
FIG. 12 is an enlarged sectional view on the line 12—12 of FIG. 7 illustrating further details of the forms of latch arrangements of FIGS. 8–11 for the well string and the whipstock.

The well string includes longitudinal keys 69 thereon as shown in FIG. 12 which extend longitudinally between members 67 adjacent the enlargements **67*a*, as shown in dotted line and solid line, to prevent relative rotation between the well string 53 and the members 67. This enables latch 65** on the well string and the well string to be rotated simultaneously to disengage the well string from the whipstock when desired.

Figure 8:
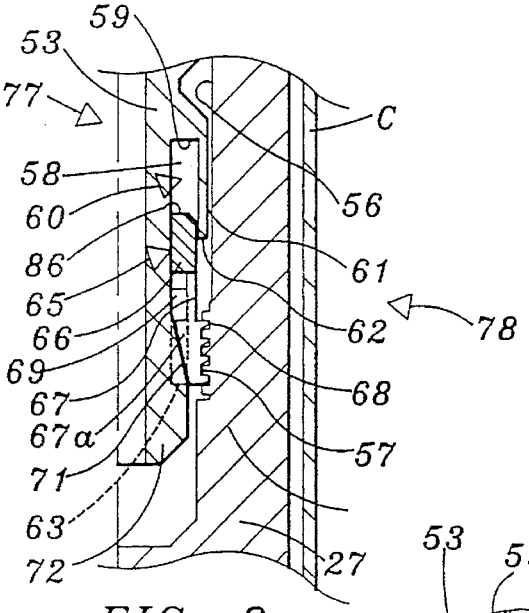
FIGS. 8 and 9 are enlarged partial sectional views showing one form of a cooperating latch arrangement on a well string and a cooperating latch arrangement on a whipstock for releasably engaging a well string with a whipstock to position the whipstock in, and retrieve it from, a well bore tubular member and for releasing the well string from the whipstock.
Figure 9:
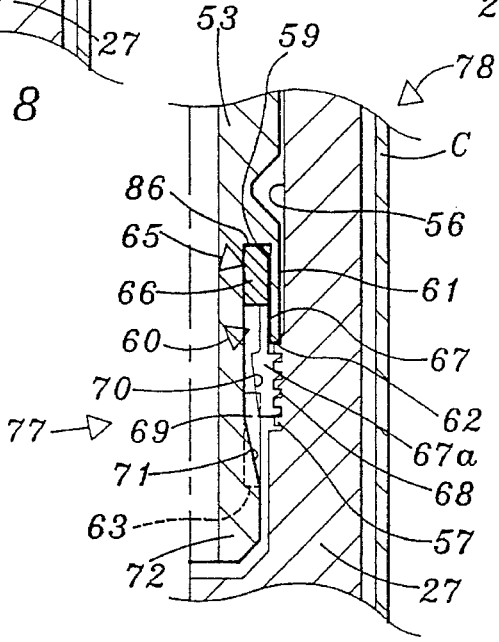

The back surface 70 of the enlargements **67*a*** on members 67 is shown as being tapered in the FIGS. 8 and 9 form to conform with the taper 71 on enlarged portion 72 on the well string form of FIGS. 8 and 9.

Figure 10:
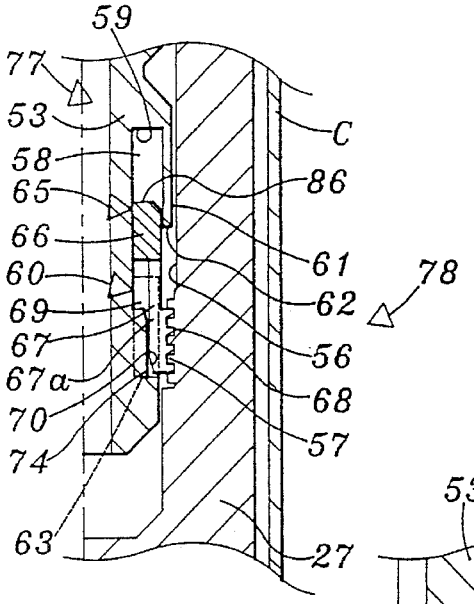
FIGS. 10 and 11 are are partial sectional views, similar to FIGS. 8 and 9, and showing another form of a cooperating latch arrangement for a well string and whipstock.
Figure 11:
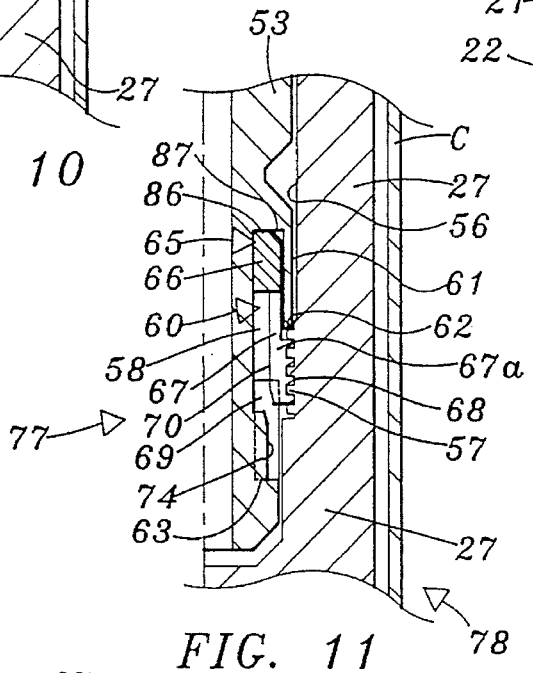

The back surface 70 of the enlargements 67*a* on members 67 is shown in an alternate form in FIGS. 10 and 11 as a generally flat surface configured to conform with the enlarged, generally flat surface 74 on the well string form shown in FIGS. 10 and 11.

When a well string 53 is to lower the whipstock into the well bore, the latch arrangement thereon is connected with the latch arrangement on the whipstock at the earth's surface and the well string and whipstock are lowered into the well bore connected together as shown in FIG. 7 to secure the shaft in the anchor A, in a manner as previously described herein.

When it is desired to release from the whipstock, the well string is rotated to the right and moved upwardly enough to assure that the end 59 of the counterbore 58 does not abut the top 86 of the latch body 66 and prevent upward movement of the latch as it unthreads from the whipstock. The well string is not moved to contact the back surfaces on the enlargements 67*a* as such contact would prevent proper release between the cooperating latch arrangements on the well string and the whipstock.

When the well string 53 is lowered to engage with the whipstock, it is pushed longitudinally into the opening 56 on the whipstock, which in the embodiment shown extends down from the face 26 of the whipstock, and end 62 of circular portion 61 contacts the top thread in the whipstock opening, as seen in FIGS. 9 and 11. The top 86 of the latch contacts the upper end 59 of the slot 60, and this pushes the threads 68 of the latch into the threads 57 in the whipstock. Since the latch is moved up in the slot 60 as shown in FIGS. 9 and 11, there is clearance for the circumferentially spaced members 67 to flex to the left as viewed in the drawings to enable them to flex and engage with the threads 57 on the whipstock as shown in FIGS. 8 and 10 to then be held in such position by engagement of the enlarged surface 72 and 74 in FIGS. 8 and 10 respectively surface of the well string when it is pulled upwardly as shown in FIGS. 8 and 10.

Sufficient pull is exerted to shear the frangible members 35*a* shown in FIG. 5 to release the latch from the anchor. Second surface 27*b* on the latch mandrel 30 of the shaft engages the bottom 52 of the latch to retrieve the latch with the whipstock from the well bore.

A centralizer 95 may be positioned on the well string 53 to assist in guiding the well string 53 to latch a whipstock in the anchor and to guide the well string into latching relation with the whipstock anchored in the well bore for retrieval thereof.

The foregoing disclosure and description of the invention are illustrative and explanatory thereof, and various changes in size, shape and materials as well as in details of the illustrated construction may be made without departing from the spirit of the invention.

What is claimed is;

1. An anchor operable by a setting tool to secure the anchor in a tubular member to receive a tool after the setting tool has been actuated and removed from the tubular member to position the tool in a desired manner in the tubular member, said anchor including:

a body having a recess thereon;

slip means supported on said body for engagement with the tubular member to secure the anchor therewith;

said body terminating in an upper end with an inclined surface thereon; and surface means on said body for cooperating with the tool to position the tool in the tubular member in the desired manner.

2. The anchor of claim 1 including:

frangible means releasably engaging said slip means on the anchor; and releasable means for releasably securing the setting tool with the anchor.

3. The anchor of claim 1 including lock means on the anchor to maintain the anchor secured with the tubular member and wherein the slip means are releasably supported on tapered surfaces on the anchor.

4. The anchor of claim 1 wherein said cooperating surface means on said body is a slot extending longitudinally from said inclined surface.

5. The anchor of claim 4 wherein the slot extends from the lowermost portion of said inclined surface.

6. The anchor of claim 1 wherein said body is a tubular body with a longitudinal bore there through and wherein said recess is formed in said longitudinal bore.

7. The anchor of claim 1 including a packer on said body expandable by actuating the setting tool to engage the packer with the tubular member.

8. The anchor of claim 6 including a packer on said tubular body expandable by actuating the setting tool to engage the packer with the tubular member.

9. The anchor of claim 4 including a packer on said body expandable by actuating the setting tool to engage the packer with the tubular member.

10. The anchor of claim 5 including a packer on said tubular body expandable by actuating the setting tool to engage the packer with the tubular member.

11. The anchor of claim 7 including lock means to maintain said packer engaged with the tubular member.

12. The anchor of claim 8 including lock means to maintain said packer engaged with the tubular member.

13. The anchor of claim 9 including lock means to maintain said packer engaged with the tubular member.

14. The anchor of claim 10 including lock means to maintain said packer engaged with the tubular member.

15. The anchor of claim 11 wherein said lock means is positioned on the anchor body above said packer.

16. The anchor of claim 11 wherein said lock means is positioned on the anchor body above and below said packer.

17. The anchor of claim 12 wherein said lock means is positioned on the anchor body above said packer.

18. The anchor of claim 12 wherein said lock means is positioned on the anchor body above and below said packer.

19. The anchor of claim 13 wherein said lock means is positioned on the anchor body above said packer.

20. The anchor of claim 13 wherein said lock means is positioned on the anchor body above and below said packer.

21. The anchor of claim 14 wherein said lock means is positioned on the anchor body above said packer.

22. The anchor of claim 14 wherein said lock means is positioned on the anchor body above and below said packer.

23. An arrangement for releasably anchoring a whipstock on an anchor secured downhole within a tubular member, the arrangement including:

a releasable latch supported on the whipstock;

an anchor surface on the anchor; and a latch surface on said latch for positioning within the anchor surface for releasably securing the whipstock with the anchor, such that the whipstock may be secured with the downhole anchor and subsequently released from the downhole anchor.

24. The arrangement of claim 23 wherein:

said anchor surface comprises a recess on the anchor; and said latch surface comprises enlargements on said releasable latch.

25. The arrangement of claim 23 including:

a first surface on the whipstock for maintaining said latch surface secured in said anchor; and a second surface on the whipstock to retrieve the latch with the whipstock from the anchor.

26. The arrangement of claim 23 wherein the anchor includes tapered surfaces thereon and slip means supported adjacent said tapered surfaces for engagement with the tubular member to secure said anchor therewith.

27. The arrangement of claim 23 wherein the anchor has a tubular body.

28. The arrangement of claim 27 wherein said tubular body has a longitudinal bore there through with a recess therein.

29. The arrangement of claim 23 including lock means to maintain the anchor secured with the tubular member.

30. The arrangement of claim 23 wherein said releasable latch is releasably supported on the whipstock by frangible means and wherein said latch includes:

a latch body;

circumferentially spaced, longitudinally extending members on said body; and enlargements on said members for positioning within the recess in the anchor.

31. The arrangement of claim 25 wherein the whipstock includes:

a shaft depending therefrom and said first surface and said second surfaces are on said shaft.

32. The arrangement of claim 6 wherein said tubular body terminates in an upper end with an inclined annular edge surface thereon and a whipstock latch surface extending longitudinally from said inclined annular edge surface.

33. The arrangement of claim 32 wherein said whipstock latch surface is a slot that extends from the lowermost portion of said inclined annular edge surface.

34. The arrangement of claim 33 wherein the whipstock includes a lug for engaging in the slot of said tubular body.

35. The arrangement of claim 27 including a packer on said tubular body for engagement with the tubular member.

36. The arrangement of claim 35 including lock means to maintain said packer engaged with the tubular member.

37. The arrangement of claim 36 wherein said lock means is on the tubular body above and below said packer.

38. A whipstock for use in a cased well bore including:

an inclined face thereon;

a shaft depending from the whipstock;

said shaft including an orientation sleeve;

means to releasably secure said inclined face of the whipstock in any desired rotated position on said orientation sleeve; and means to releasably secure the whipstock in the cased well bore.

39. The whipstock of claim 38 wherein said means to releasably secure said inclined face comprise cooperating releasable surfaces on the whipstock and on said orientation sleeve engagable to secure said inclined face in a desired rotated position on said orientation sleeve of said shaft; and means releasably connecting the whipstock with said orientation sleeve whereby the whipstock and orientation sleeve may be disconnected for disengaging said cooperating releasable surfaces on the whipstock and said orientation sleeve and then reconnected to position the whipstock in any desired rotated position on said orientation sleeve.

40. The whipstock of claim 39 wherein said cooperating surfaces comprise engagable keys and keyways on the whipstock and on said orientation sleeve of said shaft.

41. A retrievable whipstock arrangement for lowering on a well string to releasably engage with an anchor secured in a well bore prior to lowering the retrievable whipstock arrangement to engage the anchor, the whipstock arrangement comprising:

an inclined face surface on a whipstock;

a shaft depending from the whipstock;

a latch releasably supported on said shaft for releasably securing the whipstock with the anchor; and cooperating surfaces on the whipstock and on the well string for releasably securing the well string with the whipstock, such that the whipstock may be retrieved while the anchor remains secured in the wellbore.

42. The whipstock arrangement of claim 41 wherein said cooperating surfaces on the whipstock and on the well string comprise:

a longitudinal threaded opening in the whipstock extending from said inclined face surface;

a latch slidably supported on the well string;

said latch including circumferentially spaced members with threaded surfaces thereon engagable with said threaded opening; and keys on the well string between said latch members to prevent relative rotation between said latch members and the well string as the well string is rotated so that the latch members unthread from the threaded opening in the whipstock to disengage the well string from the whipstock.

43. The whipstock of claim 38 wherein said means to releasably secure the whipstock in the cased well bore is a latch supported on said orientation sleeve.

44. The retrievable whipstock arrangement of claim 41 wherein said cooperating surfaces on the whipstock and on the well string are constructed and arranged to secure the well string with the whipstock by longitudinal movement of the well string and release the well string from the whipstock body by rotation.

45. An arrangement for maintaining a predetermined fixed relationship between a whipstock face on a whipstock and a whipstock latch surface on an anchor secured downhole within a tubular member in a wellbore, the whipstock being retrievable independent of the anchor, said arrangement comprising:

a shaft extending from the whipstock;

cooperating surfaces on the whipstock and said shaft to lock the whipstock face in a predetermined relationship relative to the shaft;

a latch supported on said shaft for releasably securing the whipstock and the anchor; and said shaft includes an orientation sleeve with an orientation surface thereon for engaging the whipstock latch surface on the anchor to orientate the whipstock face in a predetermined relationship relative to the whipstock latch surface on the anchor.

46. The arrangement of claim 45 wherein:

said shaft includes a latch mandrel to support said latch thereon; and said cooperating surfaces comprise engagable keys and keyways on the whipstock and on the orientation sleeve of said shaft.

47. The arrangement of claim 46 wherein:

said surface on the orientation sleeve is a lug;

the whipstock latch surface is a longitudinal slot in the anchor; and said latch is supported on said latch mandrel of said shaft for releasably engaging with the anchor for securing the whipstock with the anchor and for releasing the whipstock from the anchor.

48. The arrangement of claim 45 including a packer on the anchor engaged with the tubular member.

49. The arrangement of claim 45 including a lock to maintain the anchor secured with the tubular member.

50. The arrangement of claim 48 including a lock to maintain the anchor secured with the tubular member.

51. The arrangement of claim 45 including a latch arrangement for releasably securing a well string with the whipstock.

52. The arrangement of claim 51 wherein said latch arrangement includes cooperating surfaces on the whipstock and the well string to secure the well string with the whipstock by longitudinal movement of the well string and to release the well string from the whipstock by relative rotation between the whipstock and the well string.

53. The arrangement of claim 52 where the longitudinal movement of the well string is downward to the face of the whipstock.

54. An arrangement for positioning a whipstock face on a well string in an anchor secured in a cased well bore tubular member for drilling a lateral well bore including:

a shaft extending from the whipstock;

said shaft including an orientation sleeve;

said shaft including a latch mandrel;

a lug on said sleeve;

the anchor including a tubular body extending upwardly there from to terminate in an upper end with an inclined annular edge surface thereon and a whipstock latching surface extending longitudinally on said tubular body from said inclined annular edge surface for receiving said lug on said sleeve; and a latch supported on said latch mandrel for releasably engaging with the anchor for securing the whipstock with the anchor and for releasing the whipstock from the anchor for retrieval from the well bore by manipulation of a well string.

55. The arrangement of claim 54 wherein said orientation sleeve partially surrounds said latch mandrel and each is secured to the whipstock and further including cooperating surfaces on the whipstock and said orientation sleeve of said shaft to lock the face of the whipstock in any of a plurality of angular predetermined relationships relative to said whipstock latching surface in the anchor tubular body.

56. The arrangement of claim 55 wherein said cooperating surfaces comprise engagable keys and keyways on the whipstock and on said orientation sleeve of said shaft.

57. The arrangement of claim 54 including a lock on the anchor to maintain the anchor secured with the tubular member.

58. The arrangement of claim 54 including a latch arrangement for releasably securing a well string with the whipstock to lower it into position in the anchor and to retrieve it from the well bore.

59. The arrangement of claim 58 wherein said latch arrangement includes cooperating surfaces on the whipstock and the well string to secure the well string with the whipstock by longitudinal movement of the well string to the face of the whipstock.

60. The arrangement of claim 59 where the longitudinal movement of the well string is downward to the face of the whipstock.

61. The arrangement of claim 54 wherein the well string is a drill string and further including:

a mill supported on the drill string and releasably secured to the face of the whipstock; and a latch arrangement in the whipstock to receive a tubular member therein to retrieve it from the well bore after the lateral well bore is drilled.

62. A retrievable whipstock for releasably securing with an anchor secured within a wellbore, including:

cooperating surfaces on the whipstock and anchor to releasably secure the whipstock with the anchor while secured in the wellbore; and cooperating releasable surfaces on the whipstock and anchor to secure the whipstock non rotatably on the anchor to face in any one of a plurality of directions relative to the anchor secured in the wellbore.

* * * * *